United States Patent [19]

Thom

[11] Patent Number: 4,648,836

[45] Date of Patent: Mar. 10, 1987

[54] ROTARY RETORT FURNACE

[75] Inventor: Terrence C. Thom, St. Catharines, Canada

[73] Assignee: Can-Eng Holdings, Ltd., Canada

[21] Appl. No.: 801,834

[22] Filed: Nov. 26, 1985

[51] Int. Cl.[4] ..... F27B 7/08; F26B 11/04

[52] U.S. Cl. ..... 432/107; 432/112; 432/239; 432/108; 165/104.16

[58] Field of Search ..... 432/107, 108, 239, 112; 165/104.16

[56] References Cited

U.S. PATENT DOCUMENTS 1,656,924 1/1928 Smith ..... 432/112

2,007,332 7/1935 Johannsen ..... 432/112

4,146,975 4/1979 Duhem ..... 432/107

4,210,491 7/1980 Schulman ..... 165/104.16

*Primary Examiner*—Henry C. Yuen

*Attorney, Agent, or Firm*—Davis Chin

[57] ABSTRACT

A continuous rotary retort furnace includes an outer shell having first and second ends. A retort assembly extends through openings in the first and second ends. The retort assembly is supported by support devices at both ends external of the shell. The retort assembly is formed of an axial member and a spirally-wound conduit disposed on the exterior surface of the axial member. A drive assembly is coupled to the support device adjacent the first end for rotating of the retort assembly.

12 Claims, 7 Drawing Figures

ROTARY RETORT FURNACE

BACKGROUND OF THE INVENTION

This invention relates generally to continuous rotary heat-treating furnaces and more particularly, it relates to a rotary retort furnace used for continuous heat processing of workpieces which include a retort assembly formed of a cylindrical axial member and a spirally-wound conduit disposed on the exterior surface of the axial member to move the workpiece from one end of the retort assembly to the other end.

Rotary retort furnaces have been utilized for many years for the continuous treatment of a variety of small metal workpieces or parts, such as bolts, nuts, screws, rivets, pins, balls, springs, clips, studs, nails, washers and the like. In these prior art furnaces, the retorts are used for the continuous processing of small packets of such parts and coneys them from one end of the retort to the other end as it rotates within a surrounding heating chamber. Such prior retorts are typically cylindrical in shape which have been generally either heavy walled rough cast retorts with internal cast spirals (flights) or fabricated retorts of wrought materials with the internal spiral welded directly to the cylindrical shell. The fabricated retorts of wrought materials have several inherent problems. One of the problems is that the manufacture of the internal flight is very expensive due to the high tolerance requirement in locating and attaching of the internal flights in close contact relationship with the sidewalls of the retort. Otherwise, the processed parts will tend to become lodged between the flight and the sidewalls. If such parts to be treated in one operation become lodged in the spaces between the flights and sidewalls of the retort and subsequently fall into or become mixed with a different sets of parts being heat treated, it can prove to be quite a burdensome and expensive task to sort the parts. The mixing of parts is not acceptable. If the amount of dwell time is controlled to be very precise, then the mixing of the parts would either prolong or reduce the dwell time. Another problem of the fabricated retorts of wrought materials is that the strength of the materials used cannot readily withstand the cyclic physical and thermal stresses which can inherent in the rotary furnaces at high temperatures.

While the cast retorts are much better able to cope with the high temperature stresses, they are not in any way free of problems. For example, since the wall of cast retorts is much thicker than in the wrought retorts, a much higher thermal environment is required to compensate for the thermal gradient in the retort wall in order to achieve the same internal temperatures. Further, due to the casting process the internal surfaces are considerably rougher than the wrought retorts which will cause a buildup of clinker (cutting swarf and cutting oils) restricting the passage of the parts and cause a reduction in the heat exchange rates and may possible damage the parts themselves.

Since rotary retort furnaces are often used with a controlled atmosphere to create a neutral (non-oxidizing) condition or to create a thermochemical combination required for heat treatment of parts, it is important to minimize the amount of gas or gases used within the furnace. In prior art designs of continuous rotating furnaces, considerable volumes of gas are utilized due to the retort configuration and the location of the small packets of parts so as to assure that a sufficient quantity of controlled atmosphere is applied to all the parts and a sufficient time is provided to obtain the desired treatment. However, the volume of gases used are relatively high, thereby increasing operating cost.

Another problem associated with these prior arts rotary furnaces is the thermal stresses developed in the internal flight and the shell of the retort due to the fact that the workpieces enter the furnaces in an extremely cold state relative to the temperature of the furnace. The degree of stress depends upon the magnitude of the temperature differential. This temperature difference can be quite substantial since the heat inputs applied to the furnace entrance is very high. As a result, the presence of this and other typical conditions may cause premature failure of the retort by cracking occurring adjacent the intersection of the flights and the shell, thereby requiring costly replacement or repair of flight and/or retort shell. Still another deficiency which has been traditionally encountered in these retort furnaces heretofore is that heat transferred to the parts was limited primarily to radiation with some heat transfer by conduction to parts adjacent to the sidewalls of the retort.

SUMMARY OF THE INVENTION

Accordingly, it is a general object of the present invention to provide an improved rotary retort furnace having a retort assembly formed of an axial member and a spirally-wound conduit disposed on the exterior surface of axial member which is relatively simple and economical to manufacture and assemble, but yet overcome the disadvantages of the prior art retort furnaces.

It is an object of the present invention to provide a rotary retort furnace which includes a cylindrical rotatable axial member and a spirally-wound conduit disposed on the exterior surface of the axial member to move workpieces from one end of axial member to the other end.

It is another object of the present invention to provide the rotary retort furnace having a retort assembly which includes a spirally-wound conduit formed of a plurality of hollow spiral revolution sections for conveying progressively parts to be heated through the furnace.

It is still another object of the present invention to provide a rotary retort furnace which includes a retort assembly and a loading and unloading device for conveying the parts to be heat treated into a spiral conduit of the retort assembly.

In accordance with these aims and objectives, the present invention is concerned with the provision of a continuous rotary retort furnace which includes an outer shell having first and second ends. A retort assembly extends through openings in the first and second ends. The retort assembly is supported by support members at both ends external of the shell. The retort assembly is formed of an axial member and spirally-wound conduit disposed on the exterior surface of the axial member. A drive assembly is coupled to the support device adjacent the first end for rotating of the retort assembly.

BRIEF DESCRIPTION OF THE DRAWINGS

These and other objects and other advantages of the present invention will become more fully apparent from the detailed description when read in conjunction with the accompanying drawings with like reference numerals indicating corresponding parts throughout, wherein.

DESCRIPTION OF THE PREFERRED EMBODIMENTS

Figure 1:
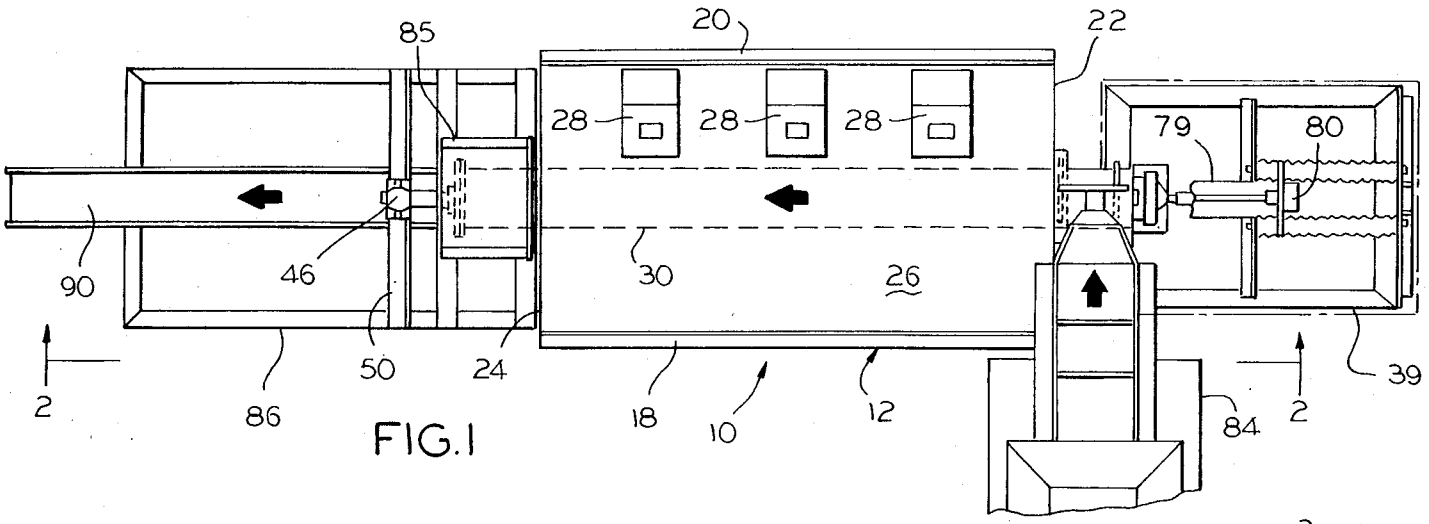
FIG. 1 is a top plan view of a rotary retort furnace constructed in accordance with the principles of the present invention.
Figure 2:
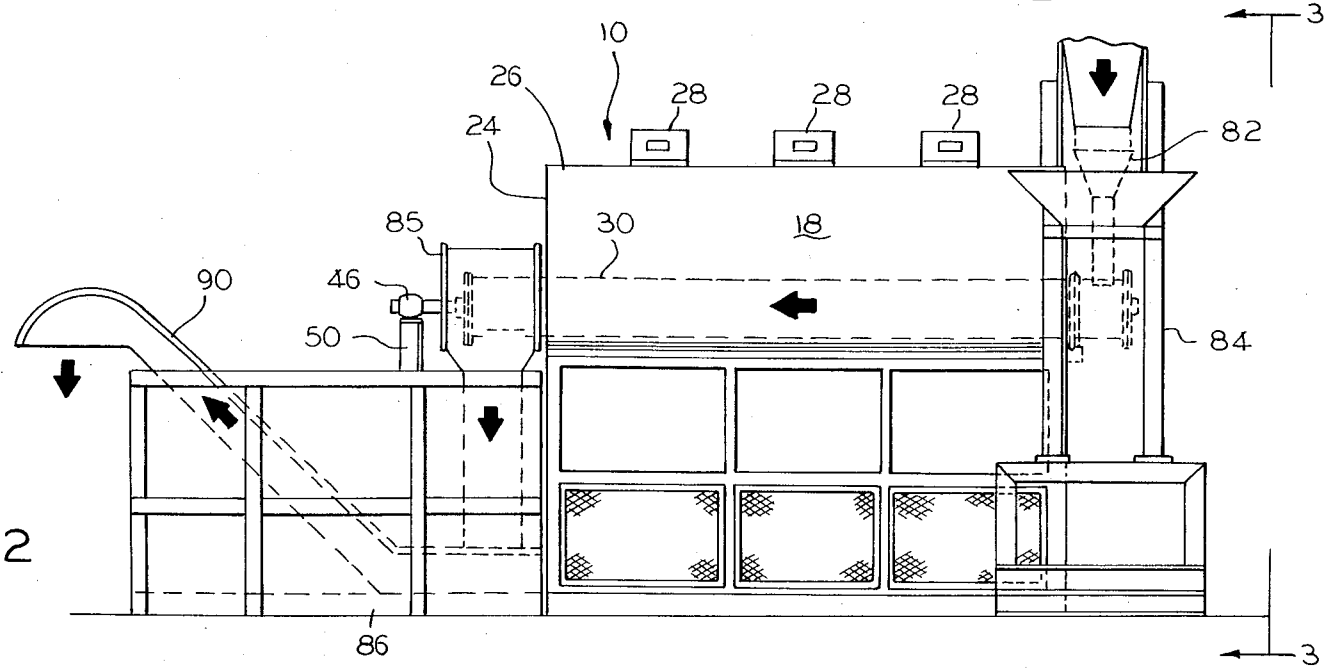
FIG. 2 is a side elevational view of the furnace, taken along the lines 2—2 of FIG. 1.
Figure 4:
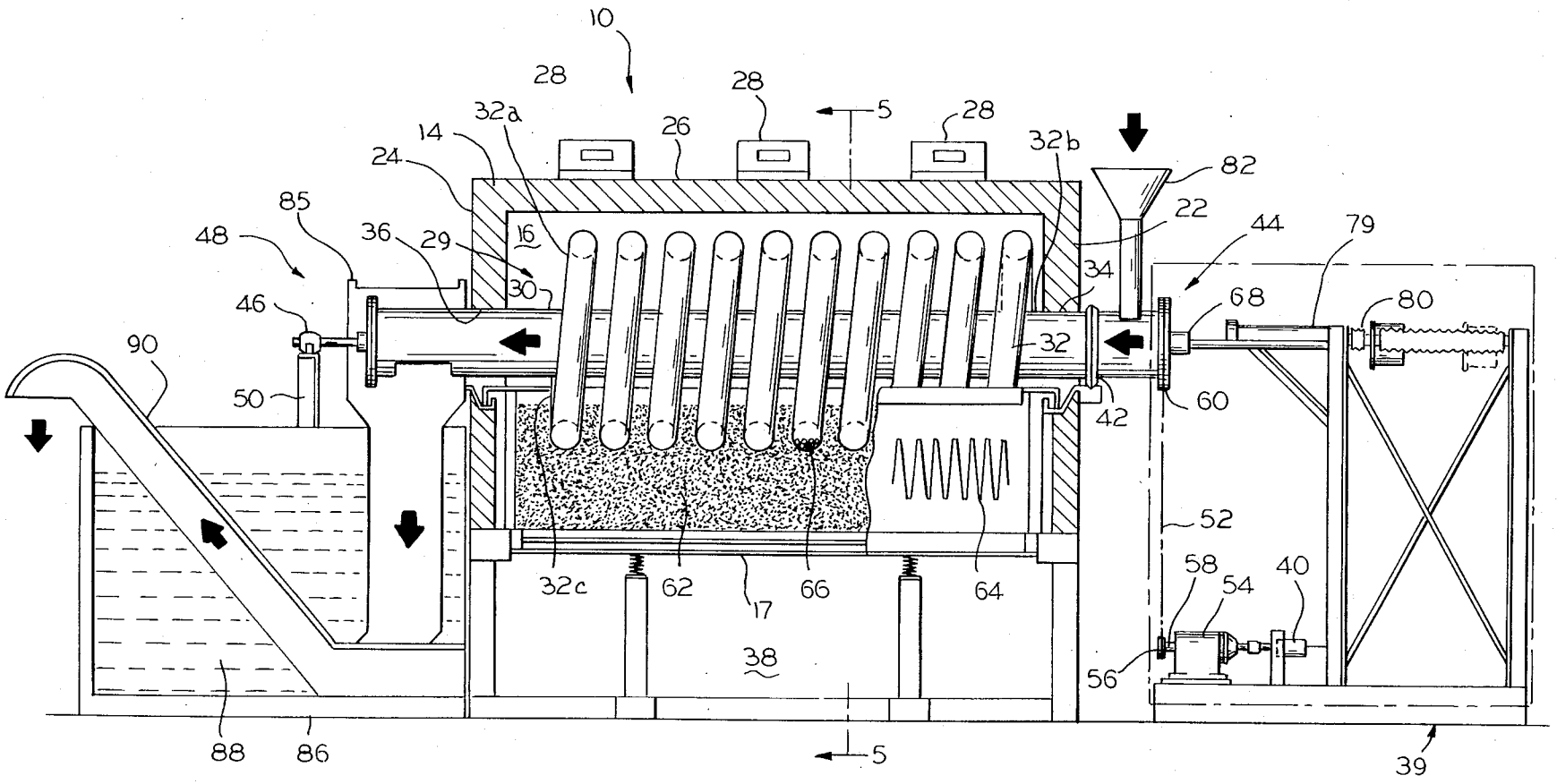
FIG. 4 is a side elevational view, partly in section, to illustrate the retort assembly of the present invention.

Referring now to the various views of the drawings, there are shown in FIGS. 1, 2 and 4 a continuous rotary retort furnace of the present invention which is generally designated by reference numeral 10. The furnace has an elongated outer shell 12 lined by a retractory material 14 and is provided with a central cavity 16. The furnace shell 12 is formed of a floor 17, sidewalls 18 and 20, end walls 22 and 24, and a roof or hood 26 which is preferrable removable to facilitate access for any necessary maintenance required within the shell. A plurality of exhaust ports 28 are disposed in the roof 26 to permit the escape of gases utilized during the operation of the furnace.

The furnace 10 includes a rotary retort assembly 29 consisting of a cylindrical rotatable axial member 30 and a spirally-wound conduit 32 disposed on the exterior surface of the axial member 30. The axial member extends longitudinally through openings 34, 36 in the respective in walls 22, 24 and is supported externally upon both ends thereof by bearings for rotation about the axis of the axial member 30. The shell 12 is supported above the ground by means of a structural metal frame assembly 38. The frame assembly 38 also provides support for a drive assembly 39 for the retort assembly including a hydraulic motor 40. A bearing 42 on drive end 44 of the axial member 30 is secured fixedly thereto for supporting the axial member in a fixed location. A bearing 46 on discharge end 48 of the axial member 30 is supported by a column member 50. The bearing 46 allows for thermal growth of the axial member. During operation of the furnace, both the axial member 30 and the spirally-wound conduit 32 will experience growth due to thermal expansions. The growth of the spirally-wound conduit 32 will be generally in the radial direction, and the growth of the axial member 30 will generally be in the longitudinal direction. Due to the spiral configuration of the retort assembly, the thermal stresses that would normally occur will not however occur because of the spring-like action of the conduit.

The drive assembly 39 includes a drive chain 52 driven by the motor 40 through a gear reduction mechanism 54 which engages a drive sprocket 56. The drive sprocket 56 is mounted on a shaft 58 of the gear mechanism 54 and is connected by means of the drive chain 52 to a driven sprocket 60 rigidly mounted on the outer end of the axially member 30. The means for driving the retort assembly 29 may be varied, of course, as by a fixed speed electric motor or a variable speed, reversible electric motor, if desired. The illustrated hydraulic motor 40 and gear reduction mechanism 54 are provided merely as an example of one practical form of a power driving means.

Figure 5:
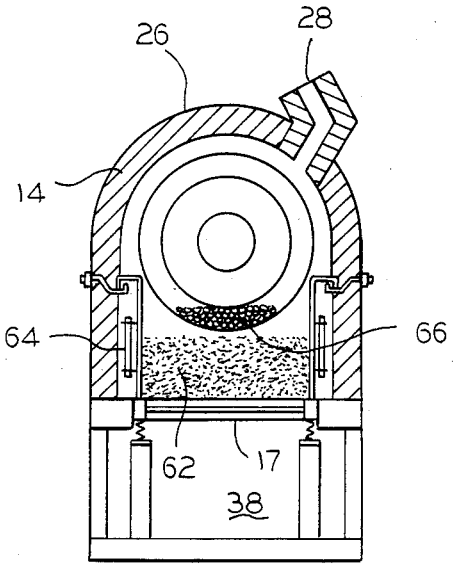
FIG. 5 is a cross-sectional view of the furnace, taken along the lines 5—5 of FIG. 4.

As can best be seen in FIGS. 4 and 5, the bottom portion of the retort assembly 29 is always immersed in a fluid heating source 62. The fluid heating source 62 may consist of either a fluidizable bed media, a molten salt bath, or molten lead bath. In the preferred embodiment of the present invention, it is preferrable to use the fluidizable media. The fluidized bed media may be heated by immersion heating or by heating externally of the retort assembly which may be either gas-fired or electric such as by electric heating elements 64.

Since parts (charge packets) 66 to be heat treated entering the furnace will come into the first turn of the spiral conduit 32 which is immersed in the fluidizable bed at all time, the parts 66 are subjected to a high temperature source at the initial state so as to provide a high rate of heat transfer. This repid heat transfer is also because the parts are totally surrounded by the heating source and are extremely close in proximity on all its surfaces to the heating source. Thus, the parts can be raised quickly to the appropriate temperature. Further, due to the fact that the spirally-wound conduit 32 is immersed in the fluidizable bed of a constant temperature throughout its length, there will be less temperature differential and thus the stresses will be reduced. The fluidizable bed also provides a bouyancy effect which aids in supporting of the retort assembly 29 throughout its entire length, thereby prolonging its useful life.

A controlled atmosphere is usually required to surround the charge packet 66 during thermochemical treatment in all cases and during thermal treatment in most cases. In the case of thermal treatment, it is generally desired to have a neutral atmosphere such as nitrogen or special mixture of exothermic gas or endothermic gas. In the case of the thermochemical treatment, the controlled atmosphere will be mixtures of nitrogen, ammonia, natural gas or rich mixtures of exothermic gas or endothermic gas. In either case, the controlled atmosphere for heat treating is admitted adjacent the drive end 44 into the axial member 30 under pressure via means of an inlet 68. Such gases are then fed into the retort assembly 29 where the gases pass through the spirally-wound conduit 32 and emerge at the discharge end 48 of the axial member.

As was previously pointed out, the retort assembly 29 consists the cylindrical rotatable axial member 30 and the spirally-wound conduit 32. The axial member 30 is made preferable of heat-resistant high-alloy steel which is manufactured either by casting or fabricating. The spirally-wound conduit 32 includes a plurality of hollow spiral revolution sections 32*a* for conveying progressively the charge packets or parts 66 to be heat treated through the rotating retort assembly 29. One end of the spiral conduit 32 is connected to the axial member 30 via a charge chute 32*b*, and the end of the conduit is connected to the axial member via a discharge chute 32*c*. While the hollow sections 32*a* are illustrated to be circular in its cross-sectional area, it should be clearly understood that the cross-sectional area of the hollow sections may be formed in any desired configuration such as square, oval, rectangular or polygon.

The specific configuration may be designed based upon the relationship of the volume (weight) of the charge packet to be heat treated to the amount of exposed surface area of the spiral conduit 32 so as to maximize heat transfer. The particular spiral configuration illustrated is referred to as a single conduit, single pass arrangement. It is also envisioned that any number of other arrangements could be used such as a single conduit with double and/or triple pass or a double or triple conduit with a single pass. Further, for the ease of illustration only a selected number of revolutions of the spiral conduit 32 have been depicted; however, it should be apparent that the number of revolutions in a typical retort furnace could be as few as only a one-half revolution to any desired maximum dependent upon the physical limitations of the material used. The design criteria on the number of revolutions will also be based upon the bulk density of the parts to be heat treated, the duration of the time that the parts must be in the furnace, and the production rate (weight per hour capacity) required from the furnace.

Therefore, the retort assembly 29 of the present invention has the advantages of providing relatively rapid heating of the parts at the initial entrance and intimate contact of the controlled atmosphere with the parts. Since the area in which the controlled gases must pass flows through all of the parts to be heat treated, the volume of the gases used will be equal to the area of the conduit 32 rather than the area of the retort in conventional furnaces. Further, the retort assembly is of a shorter length than the retort in conventional rotary retort furnaces, thereby reducing substantial cost in manufacturing and maintenance. Since the parts to be heat treated are passed in a series of charge packets 66 all contained within the spiral conduit 32 with no other connecting pass, the prior art problem of crossover of parts in adjacent flight areas causing mixing thereof has been totally eliminated. Moreover, due to the fact that the spiral conduit 32 is supported by the exterior surface of the axial member 30, the conduit 32 may be fabricated of a very thin construction, thereby reducing the amount of heat input and thus lessening thermal stresses.

Figure 6:
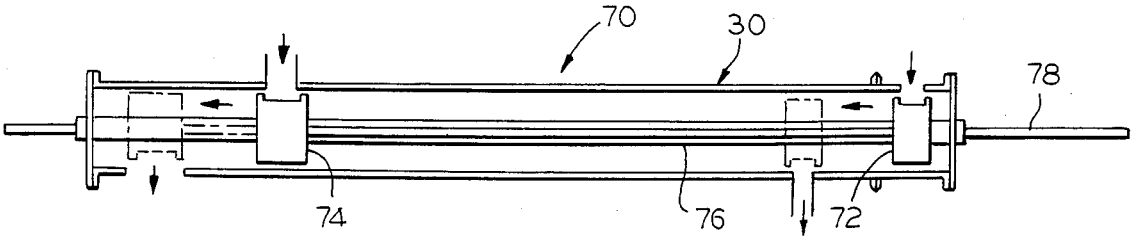
FIG. 6 is a side view showing the details of the charge-discharge assembly for use with the retort assembly of the present invention.

Referring now to FIG. 6, there is shown a charge/discharge assembly 70 for use in loading and unloading of the parts into the spiral conduit 32 of the retort assembly. The charge/discharge assembly 70 includes a charge cup or container 72 of a cylindrical shape and a discharge cup or container 74 of a cylindrical shape connected to the container 72 by means of an elongated member or rod 76. The charge/discharge assembly is housed within the axial member 30. The charge container 72 is also joined to a rod 78 which is coupled to a horizontal actuating means (FIG. 4) such as a hydraulic cylinder 79 for moving horizontally the charge/discharge assembly 70 within the axial member 30 from a loading position (solid lines) to an unloading position (dotted lines). In the unloading position, the containers 72 and 74 are rotated 180 degrees by rotatable actuating means such as rotary actuator 80 which is also coupled to the rod 78.

The operation of a charge/discharge assembly 70 will now be described. Assume initially that the containers 72 and 74 are in the extreme righthand position as shown in the solid lines of FIG. 6. The charge container 72 has its opening in the top dead center position so as to be vertically align with a loading chute 82 (FIG. 4). The loading chute 82 passes a controlled volume of parts to be heat treated from a loading mechanism 84 (FIG. 3) into the charge container 72. The discharge container 74 has its opening in the top dead center position so as to be vertically align with the discharge chute 32c of the spiral conduit 30. The discharge chute passes a previous controlled volume of parts, which as been conveyed through the conduit, from the last spiral turn to the discharge container 74. The containers 72 and 74 are then moved horizontally by the hydraulic cylinder 79 to the extreme lefthand position as shown in the dotted lines of FIG. 6. Next, the containers 72 and 74 are rotated 180 degrees by the rotary actuator 80 so that the respective openings thereof are in the bottom dead center position. As a result, the charge container becomes vertical aligned with the charge chute **32*b* of the spiral conduit for delivering the controlled volume of parts into the first spiral turn. Simultaneously, the discharge container 74 becomes vertically aligned with a quench chute 85 for delivering of the previous controlled volume of parts into a conventional quenching system 86. Finally, the containers 72 and 74 are anti-rotated 180 degrees by the rotary actuator 80 and are moved horizontally back into the extreme right hand position by the hydraulic cylinder 79. This cycle is then repeated continuously. The quenching system 86 includes a quenching bath 88 of any conventional medium such as oil or the like and a conveying means 90** for transferring the parts from the quenching tank.

Figure 7:
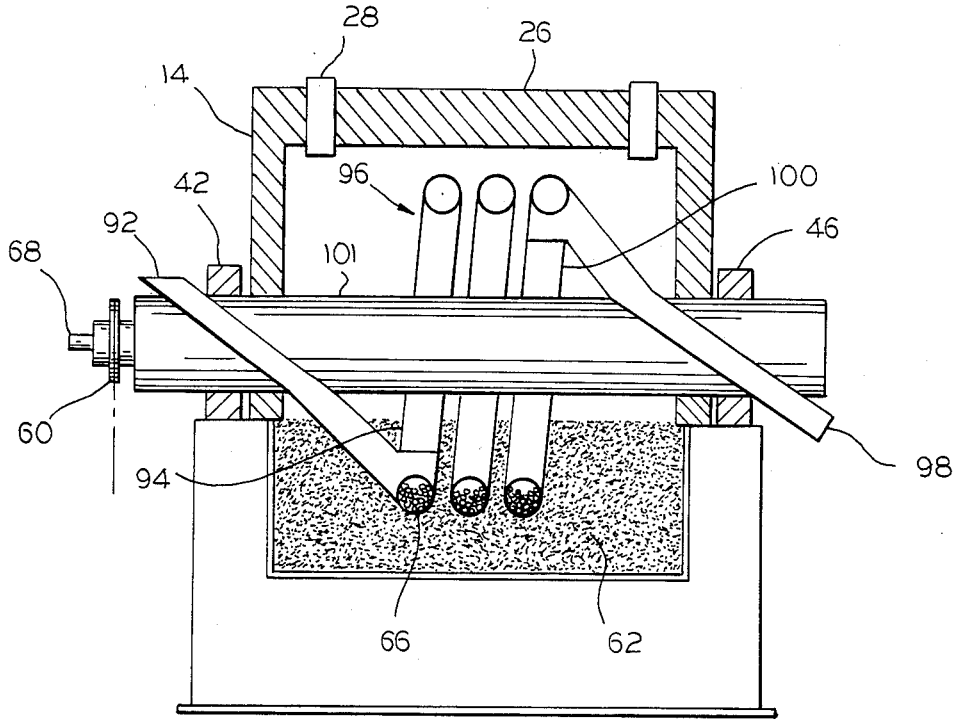
FIG. 7 shows an alternate arrangement for loading and unloading of the parts into the spirally-wound conduit.

An alternate arrangement for loading and unloading of the parts into the spiral conduit 32 is shown in FIG. 7. This arrangement uses an angled slide charge chute 92 for delivering of the parts into a first turn 94 of the spiral conduit 96 and an angled slide discharge chute 98 for delivering of the parts from a last turn 100 of the conduit. The charge chute 92 is formed integrally with the spiral conduit and is connected to the charge end of the axial member 101. The discharge chute 98 is also formed integrally with the spiral conduit and is connected at the discharge end of the axial member 101. This arrangement permits loading and unloading of the parts to and from the conduit 96 by gravity without the need of the charge/discharge assembly 70. Another alternate arrangement could be the use of an auger (not shown) for loading of the parts into the spiral conduit and an angled slide chute similar to the chute 98 for unloading of the parts from the spiral conduit.

Figure 3:
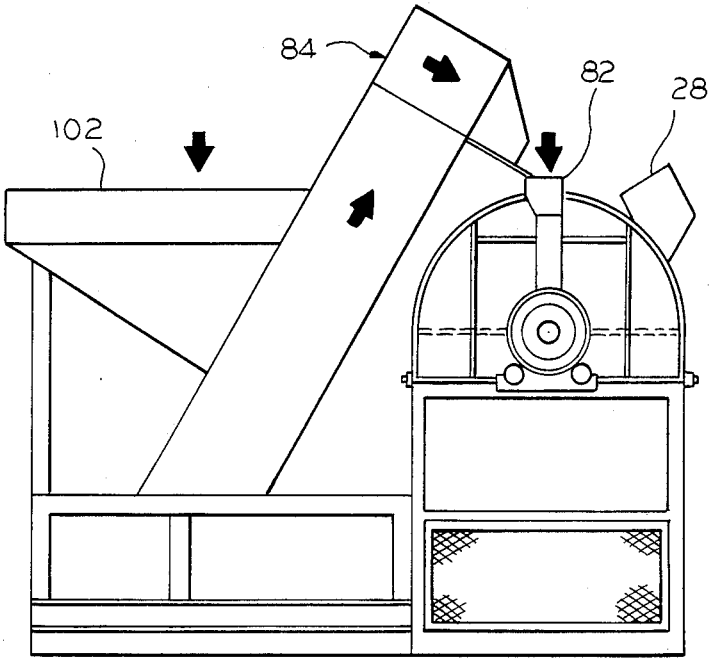
FIG. 3 is an end view of the charge end of the furnace, taken along the lines 3—3 of FIG. 2.

Turning now to the loading mechanism 84 shown in FIGS. 1, 2 and 3, there is a hopper 102 into which parts to be heat treated are conveyed by any suitable means such as a forklift truck, conveyor belt, or hand loading. The hopper 102 passes the part to the metering loader 84 which includes buckets and conveying means for delivering a controlled volume (weight) of parts through the volume controlled loading chute 82. The loading chute 82 dumps the parts in a timed sequence so that they fall into the charge container 72.

The rotary retort furnace of the present invention has the following advantages over the prior art furnaces:

(a) it requires the use of a smaller volume of gases in the controlled atmosphere;

(b) it provides intimate contact of the parts to be heat treated with the controlled atmosphere so as to facilitate uniform atmosphere parts contact;

(c) it eliminates the problem of crossover of parts in adjacent flight areas causing mixing of the parts; and (d) it provides a relatively lightweight retort assembly which is less costly to manufacture and maintain.

From the foregoing detailed description it can thus be seen that the present provides an improved continuous rotary retort furnace having a retort assembly formed of a cylindrical rotatable axial member and a spirally-wound conduit disposed of the exterior surface of the axial member to move parts to heat treated from one end of the retort assembly to the other end. Further, there are provided charge/discharge arrangement for use in loading and unloading of the parts to be heat treated into the spirally-wound conduit of the retort assembly.

While there has been illustrated and described what are at present to be considered to be preferred embodiments of the present invention, it will be understood by those skilled in the art that various changes and modification may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best mode contemplated for carrying out this invention, but that the invention will include all embodiments falling within the scope of the appended claims.

What is claimed is:

1. In a continuous rotary retort furnace, the improvements comprising, in combination:

a outer shell having first and second ends;

a retort assembly extending through openings in said first and second ends;

support means for supporting said retort assembly at both ends external of said shell;

said retort assembly being formed of an axial member and a spirally-wound conduit disposed on the exterior surface in said axial member;

drive means coupled to said support adjacent said first end for rotating of said retort assembly;

means for loading and unloading of parts to be heat treated into the spirally-wound conduit of said retort assembly; and said means for loading and unloading including a charge/discharge assembly housed within said axial member and being formed of a charge container and a discharge container connected to said charge container by a rod.

2. In a retort furnace as claimed in claim 1, wherein said spirally-wound conduit includes a plurality of hollow spiral revolution sections for conveying progressively parts to be heated through the furnace, one end of said conduit connected to said axial member via a charge chute, the other end of said conduit being connected to said axial member via a discharge chute.

3. In a retort furnace as claimed in claim 2, wherein said axial member is cylindrical in shape and said hollow spiral sections are circular in their cross-sectional area.

4. In a retort furnace as claimed in claim 1, further comprising a fluidizable bed media in which the bottom portion of said retort assembly is immersed.

5. In a retort furnace as claimed in claim 1, wherein said drive means comprises a hydraulic motor and a gear reduction mechanism.

6. In a retort furnace as claimed in claim 1, wherein said means for loading and unloading comprises a charge/discharge assembly housed within said axial member and being formed of a charge container and a discharge container connected to said charge container by a rod.

7. In a retort furnace as claimed in claim 1, wherein said charge/discharge assembly is adapted for movement horizontally between first and second positions and for 180 degree rotational movement in said first and second positions.

8. In a retort furnace as claimed in claim 7, wherein said charge container receives the part to be heated treated from a loading mechanism and said discharge container receives the parts from the last turn of the spiral conduit in said first position and wherein said charge container delivers the parts to be heat treated into the first turn of said spiral conduit and said discharge container delivers parts to a quenching system in said second position.

9. A continuous rotary retort furnace for heat treating of metallic parts comprising:

an outer shell having first and second ends;

a retort assembly extending through openings in said first and second ends;

support means for supporting said retort assembly at both ends external of said shell;

said retort assembly being formed of an axial member and a spirally-wound conduit disposed on the exterior surface of said axial member;

said spirally-wound conduit including a plurality of hollow spiral revolution sections for conveying progressively parts to be heated through the furnace, one end of said conduit being connected to said axial member via a first charge chute, the other end of said conduit being connected to said axial member via a first discharge chute;

said support means including a first bearing secured fixedly to said axial member adjacent said first end for supporting said axial member in a fixed location and a second bearing positioned to support said axial member adjacent said second end to permit thermal growth of said axial member;

a fluidizable bed media for assisting in supporting of said retort assembly throughout its entire length, said spirally-wound conduit being immersed in said fluidizable bed media throughout its length to obtain a constant temperature;

drive means including a hydraulic motor and a gear reduction mechanism coupled to said support means adjacent to said first end for rotating of said retort assembly;

means for loading and unloading of the parts to be heat treated into the spiral conduit of said retort assembly; and said means for loading and unloading including an angled slide charge chute for delivering the parts into a first turn of the spiral conduit via said first charge chute and an angled slide discharge chute for delivering the parts from a last turn of the spiral conduit via said first discharge chute.

10. A continuous rotary furnace comprising:

an outer shell having first and second ends;

a retort assembly extending through openings in said first and second ends;

support means for supporting said retort assembly at both ends external of said shell;

said retort assembly being formed of axial member and a spirally-wound conduit disposed on the exterior surface of said axial member;

drive means coupled to said support means adjacent said first end for rotating of said retort assembly;

means for loading and unloading of the parts to be heat treated into the spiral conduit of said retort assembly; and said means for loading and unloading including a charge/discharge assembly housed within said axial member and being formed of a charge container and a discharge container connected to said charge container by a rod.

11. A retort furnace as claimed in claim 1, wherein said charge/discharge assembly is adapted for movement horizontally between first and second positions and for 180 degrees rotational movement in said first and second positions.

12. A retort furnace as claimed in claim 11, wherein said charge container receives the part to be heated treated from a loading mechanism and said discharge container receives the parts from the last turn of the spiral conduit in said first position and wherein said charge container delivers the parts to be heat treated into the first turn of said spiral conduit and said discharge container delivers parts to a quenching system in said second position.

* * * * *